US006322946B1

(12) United States Patent
Mahabadi et al.

(10) Patent No.: US 6,322,946 B1
(45) Date of Patent: Nov. 27, 2001

(54) POLYBLEND POLYMERIC COMPOSITE AND MICROCAPSULE TONERS, AND A PROCESS FOR PRODUCING THE SAME

(75) Inventors: Hadi K. Mahabadi; Michael F. Cunningham; Heather M. Wright, all of Ontario (CA)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 08/297,946

(22) Filed: Aug. 31, 1994

(51) Int. Cl.[7] ..... G03G 9/087; G03G 9/093

(52) U.S. Cl. ..... 430/137.12; 430/109.3; 430/110.1; 430/110.2; 430/137.17

(58) Field of Search ..... 430/111, 138, 430/109, 137, 137.12, 137.17, 110.2, 110.1, 109.3; 526/79–81; 523/201; 525/902

(56) References Cited

U.S. PATENT DOCUMENTS

| | | | | |
|---|---|---|---|---|
| 3,974,078 | * | 8/1976 | Crystal | 430/138 |
| 4,626,489 | * | 12/1986 | Hysou | 430/137 |
| 5,164,282 | | 11/1992 | Mahabadi | 430/109 |
| 5,213,934 | * | 5/1993 | Sacripante et al. | 430/137 |
| 5,225,279 | | 7/1993 | Redlich et al. | 428/402.2 |
| 5,236,629 | | 8/1993 | Mahabadi et al. | 252/511 |
| 5,264,314 | | 11/1993 | Mahabadi et al. | 430/137 |
| 5,288,585 | | 2/1994 | Mahabadi et al. | 430/137 |
| 5,306,593 | | 4/1994 | Cunningham et al. | 430/137 |
| 5,444,140 | * | 8/1995 | Paine et al. | 430/137 |

OTHER PUBLICATIONS

Gray et al., "A Novel, Thermal Instability in a 'Semi–Batch' Reactor," *Process Safety Progress* vol. 12, No. 1, pp. 49–54. (Jan. 1993).

O'Driscoll et al., "Kinetic Analysis of a Starved Feed Polymerization Reactor," *Polymer Reaction Engineering*, vol. 1, No. 1, pp. 111–144 (1992).

Bourne et al., "Some Factors Determining The Critical Feed Time Of A Semi–Batch Reactor," *Trans IChemE*, vol. 69, Part A, pp. 321–323. (Jul. 1991).

Li et al., "Semi–Batch Processes for Emulsion Polymerisation," *Polymer International*, vol. 29, No. 1, pp. 41–46. (Jan. 1992).

O'Driscoll et al., "Kinetic Analysis of a Starved Feed Polymerization Reactor," *Polymer Reaction Engineering*, vol. 1, No. 1, pp. 229–236 (1992).

* cited by examiner

*Primary Examiner*—Janis L. Dote
(74) *Attorney, Agent, or Firm*—Oliff & Berridge, PLC

(57) ABSTRACT

Toner particles may be produced using a semisuspension polymerization process, which includes: (a) providing a mixture of a partially polymerized monomer or comonomers near the onset of the gel-effect; (b) forming a suspension of the partially polymerized monomer or comonomers; and (c) suspension polymerizing the partially polymerized monomer or comonomers while slowly adding a second monomer or comonomers in a starved feed manner. The process may be used to produce toner particles having varied particle properties, and having a morphology ranging from core-shell and inverted core-shell microcapsules to pseudo core-shell microcapsules and to polyblend composites having a low molecular weight phase dispersed in a high molecular weight matrix.

29 Claims, 1 Drawing Sheet

POLYBLEND POLYMERIC COMPOSITE AND MICROCAPSULE TONERS, AND A PROCESS FOR PRODUCING THE SAME

BACKGROUND OF THE INVENTION

This invention relates to a semi-suspension polymerization process for producing polyblend polymeric composites and microcapsules with varying core-shell morphologies, and more particularly to a starved feed semi-suspension polymerization process. Such process is particularly useful in the production of in situ and conventional toner resins, and in the production of particles with a wide range of product properties.

The resins produced by the starved feed semisuspension polymerization process may be utilized for making dry electrostatographic toners and developers according to known methods. Such toners and developers may then be used in conventional electrostatographic imaging processes. The resins produced according to the described methods may also be used in liquid developers and inks, for example, for ink jet applications.

Conventional toner resins and methods for producing such resins are known in the art. Similarly, polyblend polymeric composites and methods for producing such composites are also known in the art. Such toner resins and polyblend composites may be produced by a variety of different methods. Such methods include suspension polymerization, solution polymerization, anionic polymerization, emulsion polymerization and batch emulsion polymerization.

Semi-suspension polymerization processes are known in the art. For example, U.S. Pat. Nos. 5,164,282, 5,236,629 and 5,288,585, the disclosures of which are totally incorporated herein by reference, disclose processes for preparing toner particles wherein at least one resin monomer is bulk polymerized with a polymerization initiator, a cross-linking component and a chain transfer agent until partial polymerization has been accomplished, and thereafter mixing pigments, dyes, conductive fillers, charge control agents, initiators, chain transfer agents, cross-linking agents or other particles with the partially polymerized product and thereafter heating the mixture to complete the suspension polymerization process. Also, U.S. Pat. No. 5,264,314, the disclosure of which is totally incorporated herein by reference, discloses a process for preparing toner compositions wherein at least one monomer is mixed with a polymerization initiator, a cross-linking component and a chain transfer agent, and the mixture is bulk polymerized until partial polymerization to near the onset of gel-effect occurs. Thereafter, the partially polymerized component is mixed with pigment or dye particles and a stabilizing component, and suspension polymerization is completed by heating the mixture. U.S. Pat. No. 5,225,279 discloses a two-stage process for forming microcapsules to encapsulate a solvent. The first and optional second stages are emulsion polymerizations of a monomer. In the optional second stage, a second monomer is added to the emulsion and is polymerized to further encapsulate the core material. However, none of these references disclose a starved feed semi-suspension polymerization process.

U.S. Pat. No. 5,306,593 discloses a starved feed semi-suspension polymerization process for producing polyblend toner particles comprised of resins with high molecular weight polymer domains dispersed in a low molecular weight polymer matrix. The reference does not disclose polyblend toner particles comprised of a resin with low molecular weight polymer domains dispersed in a high molecular weight polymer matrix, nor does it disclose the production of toner particles having core-shell, pseudo core-shell or inverted core-shell morphologies.

Other starved feed polymerization processes are also known in the art, although not as applied to the production of toner and developer compositions.

A discussion of theoretical and experimental studies of starved feed polymerization processes may be found in art publications. For example, a discussion of reaction kinetics focusing upon the monomer and initiator ratios may be found in O'Driscoll and Burczyk, "Kinetic Analysis of a Starved Feed Polymerization Reactor," *Polymer Reaction Engineering*, Vol. 1, No. 1, pp. 111–144 (1992), the full disclosure of which is incorporated herein by reference. Further kinetic analysis of semi-batch reaction processes, directed towards the possibility of explosive hazards due to thermal instability of such processes, is presented in Gray, Coppersthwaite and Griffiths, "A Novel, Thermal Instability in a 'Semi-Batch' Reactor," *Process Safety Progress*, Vol. 12, No. 1, pp. 49–54 (1993), the full disclosure of which is incorporated herein by reference. Also, an experimental analysis of the critical feed time for starved feed addition may be found in Bourne and Thoma, "Some Factors Determining the Critical Feed Time of a Semi-Batch Reactor," Trans IChemE, Vol. 69, Part A. pp. 321–323 (1991), the full disclosure of which is incorporated herein by reference.

Recently, there has been tremendous growth in the quantity and variety of rubber-modified polyblend polymers. This growth is because the toughness of a material can be significantly enhanced by blending the material with a few percent of an elastomeric component. This approach is used, for example, with high impact polystyrene. However, conventional processes for producing such polyblend polymers possess several disadvantages and problems which reduce the usefulness of such processes in the toner/developer field. For example, some toners incorporate wax to improve the release properties of the toner composition. If the wax is not well dispersed in the toner, the wax will gradually accumulate in the imaging apparatus and contaminate the machine's subsystems. Further, polyblends are usually prepared by conventional processes of either melt-mixing or solution casting. Solution casting is time consuming and involves high cost of solvent handling, removal, treatment and disposal. Also, melt mixing of two incompatible polymers is very difficult, especially when the viscosities of the two polymers are very different. In order to achieve good dispersions of incompatible polymers, the conventional processes frequently require the addition of compatibilizers such as block or graft copolymers.

Another disadvantage of conventional methods for producing polyblend polymers is that the processes do not offer the flexibility to control particle morphology. As a result, the particles are typically uniform in composition. Although a uniform composition may be suitable for some applications, the uniformity considerably restricts the range of applications for which a particle material may be used.

SUMMARY OF THE INVENTION

The present invention provides a starved feed semi-suspension polymerization process which overcomes above-described problems and disadvantages of conventional processes.

The present invention provides a polymerization process for producing microcapsules and polyblend polymeric materials. The process provides for much greater flexibility in controlling particle morphology, thus allowing the production of an entire spectrum of product properties and morphologies. In the case of polyblend composite particles, the particles comprise a resin with low molecular weight polymer domains dispersed in a high molecular weight polymer matrix. In the case of microcapsules, such microcapsules may have core-shell or pseudo core-shell morphologies ranging from distinct core-shell to partially-inverted core-shell to inverted core-shell.

Core-shell and polyblend morphologies each possess distinct advantages that may make them desirable for use in electrostatographic toners. A toner particle possessing a thin shell made of a polymer having a higher glass transition temperature than the core polymer will be less prone to blocking than a toner particle without such a shell. Therefore, it becomes possible to make toner compositions that fuse at a lower temperature by providing a thin shell of a polymer around a core polymer, wherein the shell polymer has a higher glass transition temperature than the core polymer. Furthermore, a shell provides passivation in the charging of toner particles during the electrostatographic development process. When different pigments or other additives are added to the toner, or the concentration of such additives is varied, the charging characteristics of the toner particle is changed. This effect is undesirable as it requires changes to the development conditions. However, by adding a shell onto toner particles, the toner charging characteristics become dominated by the shell polymer and are much less affected by variation of pigments or other additives.

One potential disadvantage of core-shell morphologies is that differences in the refractive indices of the core and shell polymers will cause light to be scattered, resulting in low gloss and changes in the appearance of colors. For core-shell toner particles where this is an issue, such as where there is a difference in the refractive indices, a pseudo core-shell morphology may be used. In the pseudo core-shell morphology, the amount of light scattered can be reduced by creating a gradual gradient of composition and by tailoring the composition of the shell polymer.

Polyblend morphologies enable the advantageous properties of two or more different polymer resins to be combined in a single resin. In the preparation of conventional toner compositions by melt blending or extrusion, different polymer resins may be co-extruded to give a resin with desired properties. For example, one resin may provide elastic properties while a second resin provides viscous flow properties. By combining these resins in the appropriate ratio, the properties of the toner resin may be controlled. However, when different polymer resins are melt blended or extruded, they do not mix well and the polymer present in the lowest concentration will phase separate and form dispersed islands of the minor phase polymer in the continuous phase polymer (major component). This problem is especially pronounced in the conventional melt blending or co-extrusion of low molecular weight polymers in high molecular weight polymers, where stabilization of the dispersed (low molecular weight) polymer phase can be difficult because of the high mobility of the low molecular weight polymer and the greater tendency for it to coalesce into larger domain sizes within the high molecular weight polymer matrix. Compatibilizers such as block or graft copolymers are typically required since most polymers are not thermodynamically compatible. Even with compatibilizers, it can be difficult to achieve small domain sizes in a melt blending or extrusion process. Preparation of polyblend morphologies by the semi-suspension polymerization process with starved feed monomer addition minimizes these problems and yields particles with very small domains of the dispersed phase (0.05–0.3 microns) without the use of added compatibilizers.

Embodiments of the present invention therefore allow for control of the flow and charging behavior of toner compositions, independent of pigment type or core polymer composition. Embodiments of the present invention also produce polyblend polymeric materials that are characterized by good dispersions of incompatible polymers without the necessary addition of compatibilizers such as block or graft copolymers.

Embodiments of the invention also provide new and improved toner compositions with varying core-shell morphologies and lower melting temperatures, and which provide improved blocking performance, pigment passivation, impact strength and film-forming properties.

This invention provides a starved feed semisuspension polymerization process for producing polymer resins such as toner resins, comprising the steps of:

(a) providing a mixture of a partially polymerized monomer or comonomers near the onset of the gel-effect;

(b) forming a suspension of the partially polymerized monomer or comonomers; and (c) suspension polymerizing the partially polymerized monomer or comonomers while slowly adding a second monomer or comonomers in a starved feed manner.

The starved feed semi-suspension polymerization process of the present invention is particularly useful for the preparation of toner resins having varying core-shell and polyblend morphologies. In embodiments of the present invention, polyblend composite materials may be produced comprising a low molecular weight dispersed phase in a high molecular weight continuous phase (matrix). In addition to dry toners, the resins produced by the described process may also be utilized in liquid developers and inks suitable, for example, for ink jet applications.

DETAILED DESCRIPTION OF PREFERRED EMBODIMENTS

Figure 1:
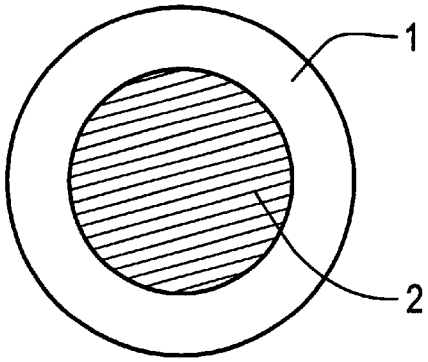
FIG. 1 shows a toner particle of the present invention having a distinct core-shell morphology.

The present invention provides a new process for producing toner and developer compositions. The toner particles are produced by a semi-suspension polymerization process that combines a starved feed suspension polymerization with another polymerization process, such as bulk polymerization. The present invention thereby produces toner particles having a wide range of product properties and desired morphologies ranging from core-shell and inverted core-shell microcapsules to pseudo core-shell microcapsules and even to polyblend composites.

More specifically, the present invention provides a process for producing toner particles comprising providing a mixture of a partially polymerized monomer or comonomers near the onset of the gel-effect, forming a suspension of the partially polymerized monomer or comonomers and suspension polymerizing the partially polymerized monomer or comonomers while slowly adding a second monomer or comonomers in a starved feed manner. The mixture of the partially polymerized monomer or comonomers near the onset of the gel effect may be provided, for example, by dissolving a polymer in a monomer or comonomers in appropriate ratios, or by polymerizing a mixture of monomer or comonomers with a polymerization initiator to the appropriate percent of conversion. When a suspension of this mixture is being suspension polymerized, the resultant toner particle properties and morphology may be adjusted by varying the starved feed monomer or comonomers and the time during the suspension polymerization process at which the starved feeding of such monomer or comonomer is begun.

As discussed below, additional process steps may be added to the process of the present invention to produce specific toner and developer compositions with desired particle properties and morphologies. Although the present invention is described in detail with reference to specific embodiments thereof, it is understood that the following discussion is not limited to those specific embodiments.

Also, the process of the present invention is directed to the preparation of black or colored toner particles with an average volume particle diameter of from about 5 microns to about 25 microns, and preferably from about 3 to about 7 microns. The toner particles comprise a resin binder synthesized to have any desirable average molecular weight, for example a number average molecular weight of from about 2,000 to about 500,000, a weight average molecular weight of from about 4,000 to about 3,000,000, and any desired molecular weight distribution.

An embodiment of the present invention is comprised of (1) mixing a monomer or comonomers with a polymerization initiator; 2) effecting bulk polymerization by increasing the temperature of the mixture to from about 50° C. to about 120° C., and more preferably from about 60° C. to about 80° C., until the degree of conversion is within about 1% to about 5% of the onset of the gel-effect, which is typically from about 10% to about 40% conversion; (3) stopping the bulk polymerization process by reducing the temperature of the partially polymerized monomer; (4) mixing with the partially polymerized monomer product pigments, charge control agents and other additives using a high shear mixer to formulate a uniform organic phase; (5) dispersing the organic phase into from about 2 to about 5 times its volume of water containing from about 0.1 to about 5 weight percent of a stabilizing component using a high shear mixer; (6) transferring the resulting toner suspension to a reactor and increasing the process temperature to from about 50° C. to about 120° C. to initiate suspension polymerization of the monomer or comonomers to a polymer product; (7) commencing starved feed addition of a chosen monomer with or without simultaneous starved feed addition of an initiator, i.e., slowly feeding the specified monomer into the reaction vessel such that the rate of addition is less than the rate of monomer absorption in the particles due to reaction and swelling; (8) continuing heating to fully polymerize the starved fed monomer; (9) washing the product with water and/or an alkyl alcohol having from 1 to about 20 carbon atoms, such as methanol; (10) separating the resultant polymer particles by, for example, filtration or centrifugation; (11) drying the toner particles obtained; and (12) optionally dry blending the toner particles with flow additives such as colloidal silica, charge control additives or other desired additives.

In another embodiment of the present invention, there is provided a process for the preparation of toner particles as described above, but wherein steps (1) and (2) are replaced by steps not requiring bulk polymerization. This embodiment comprises (1) dissolving a polymer in a monomer to prepare a monomer-polymer solution similar to that obtained by bulk polymerization to between about 10% and about 40% conversion; and (2) adding polymerization initiator to the solution mixture. In this embodiment, processing according to steps (3) to (12) may proceed as outlined above.

In a further embodiment of the present invention there is provided a process for the preparation of polyblend composite toner particles as described above, but wherein the monomer added in step (7) is more hydrophobic than the polymer material already in the reaction vessel. In this embodiment, processing according to steps (1) to (12) may proceed as outlined above, with the one change to step (7).

One skilled in the art will readily recognize that the embodiments described above, and additional embodiments, may be combined as necessary. For example, the second and third embodiments described above may be combined into yet a fourth embodiment, wherein the initial bulk polymerization is replaced by the monomer-polymer solution, and wherein the monomer added in step (7) is more hydrophobic than the monomer and polymer in the monomer-polymer mixture.

The starved feed addition step (7), discussed above, involves the addition of a selected monomer or monomers to the reactor vessel in which polymerization of the reaction mixture has begun. In the process of the present invention, the monomer or monomers is/are added to the reaction vessel at a rate of addition which is less than or equal to the rate of monomer absorption by the particles due to reaction and swelling. If the rate of starved feed monomer addition exceeds the rate at which monomer is absorbed into particles, then new monomer droplets will form. Initiator from existing particles or initiator that is added in the starved feeding may initiate polymerization in these droplets. The resulting product will then comprise the desired toner particles mixed with large particles of the polymerized starved feed monomer that do not contain the required toner additives such as pigments and charge control agents.

The starved feed addition of the monomer or monomers may be commenced anytime after polymerization of the reaction mixture has begun. Variation in the starting time can be used to control the particle morphology. For example, if the starved feed addition is begun immediately after the polymerization is commenced, the resulting structure of the particles will be a distinct core-shell or inverted core-shell. As a further example, if the starved feed addition of the monomer or monomers is begun later in the polymerization step, the resulting structure of the particles will be a pseudo core-shell or polyblend morphology. By varying the time of the starved feed addition of the monomer or monomers into the reaction mixture undergoing polymerization, the resulting morphology of the particles may be varied over an entire spectrum of core-shell to inverted core-shell and polyblend.

For example, if the starved feed monomer is more hydrophobic than the partially polymerized monomer or comonomers, and the starved feed is begun early in the polymerization process, then the starved feed monomer will diffuse into the core of the particles and polymerize, thereby producing an inverted core-shell morphology.

In the case of the production of toner particles having a polyblend composite morphology, it is preferred that the starved feed addition of the monomer or comonomers be commenced only after very high conversion of the suspension polymerized particles has occurred. Such high conversion rate of the suspension polymerized particles is desired because it is preferred that the polyblend particles be comprised of two homopolymers, rather than a copolymer of the pre-polymerized monomer or comonomers and the starved feed monomer or comonomers. If monomer or comonomer from the original system remains in the reaction suspension, the starved feed monomer or comonomers may form a copolymer with the remaining monomer, rather than forming a homopolymer as desired. Therefore, in preferred embodiments of the present invention, it is desired that the partially polymerized monomer or comonomer be suspension polymerized to at least 80% conversion before starved feed addition of monomer or comonomers is commenced. However, starved feed addition may be commenced earlier depending on the desired properties and morphology of the toner particles.

As described above, one embodiment of the present invention utilizes a starved feed monomer which is more hydrophobic than the partially-polymerized monomer and polymers. The result of using a more hydrophobic starved feed monomer is that when the monomer reaches the particle surface, it begins diffusing toward the particle core. If the starved feed monomer also includes initiator, or if some of the initiator originally added to the particles is still present in the particles, the monomer will begin to polymerize within the core of the particle and form a copolymer. If the starved feed monomer is miscible in the polymer matrix, but its polymer is immiscible, upon polymerizing the starved feed monomer will phase separate into small domains. (If the starved feed polymer is miscible in the matrix polymer, then there will be no phase separation. The resulting morphology will be a homogeneous blend of the starved feed polymer in the matrix polymer. However, most pairs of polymers are not miscible.) This embodiment allows the production of polyblends, or polymeric composite particles, ranging in size from about 1 to about 300 microns, and containing dispersed phase domain sizes of about 0.05 to about 0.3 microns.

However, if the starved feed monomer is less hydrophobic, or is hydrophilic, as compared to the partially polymerized monomer or monomers, the starved feed monomer or monomers will not diffuse toward the particle core.

Illustrative examples of monomer or comonomers that may be selected for the processes of the present invention and be present in effective amounts as illustrated herein, for example, include, but are not limited to, vinyl monomers of styrene and its derivatives such as styrene, α-methylstyrene, p-chlorostyrene and the like; monocarboxylic acids and their derivatives such as acrylic acid, methyl acrylate, ethyl acrylate, butyl acrylate, dodecyl acrylate, octyl acrylate, phenyl acrylate, methacrylic acids, methyl methacrylate, ethyl methacrylate, butyl methacrylate, octyl methacrylate, acrylonitrile, acrylamide and the like; dicarboxylic acids having a double bond and their derivatives such as maleic acid, monobutyl maleate, dibutylmaleate and the like; vinyl esters such as vinyl chloride, vinyl acetate, vinyl benzoate and the like; vinyl ketones such as vinyl methyl ketone, vinyl ether ketone and the like; vinyl ethyl ether and vinyl isobutyl ether; vinyl naphthalene; unsaturated mono-olefins such as isobutylene and the like; vinylidene halides such as vinylidene chloride and the like; N-vinyl compounds such as N-vinyl pyrrole and the like; and mixtures thereof. Generally styrene acrylates, styrene methacrylates, styrene butadienes, and the like can be selected for the processes of the present invention.

The starved feed monomer or monomers used in the present invention may also be selected from the above illustrative examples of monomer or monomers. The starved feed monomer or set of comonomers is preferably different from the partially polymerized monomer or set of comonomers. Specific selection of the starved feed monomer or monomers will depend upon the specific particle composition, core-shell morphology and particle properties desired of the resultant toner particles. For example, in one embodiment of the present invention, consideration in selecting the starved feed monomer includes whether said monomer is hydrophobic or hydrophilic as compared to the polymer material already in the reactor vessel.

In embodiments of the present invention, as described above, it is possible to produce polyblend or polymeric composite particles. Such particles may have a low molecular weight dispersed phase in a high molecular weight continuous phase or matrix. The molecular weights of the low and high molecular weight phases of the polyblend particles may be adjusted according to the desired properties of the resultant resin. However, in embodiments of the present invention, it is preferred that the low molecular weight dispersed phase have a weight average molecular weight of less than about 5,000. It is also preferred that the high molecular weight continuous phase have a weight average molecular weight of from about 20,000 to about 3,000,000.

Methods of controlling the molecular weight of the low molecular weight polymer forming the dispersed phase are known in the art, and may be readily applied to the polymerization process of the present invention. Generally, the molecular weight of the dispersed phase polymer may be controlled by varying the amount of polymerization initiator, cross-linking agent, and/or chain transfer agent present in the reaction medium when the starve feed polymer is being added. The molecular weight may also be controlled by adding additional polymerization initiator concurrent with the starve feed monomer. Specifically, the molecular weight of the low molecular weight polymer dispersed phase may be controlled to the preferred values by maintaining a low cross-linker concentration, a high chain transfer agent concentration and/or a high initiator concentration in the reaction medium when the starve feed polymer is being added.

Examples of initiator that may be selected for the process of the present invention and present in effective amounts such as from about 0.1 weight percent to about 10 weight percent and more preferably from about 1 percent to about 5 percent as illustrated herein, include, but are not limited to, azo and diazo compounds such as azoisobutyronitrile, azodimethylvaleronitrile, azobiscyclohexanitrile, 2-methylbutyronitrile, diazoamineazobenzene and the like and peroxide compounds such as dibenzoyl peroxide, di-(n-propyl) peroxydicarbonate, tbutyl benzoate, t-amyl(2-ethylhexyl)monoperoxydicarbonate, 2,2-di-(t-butyl-peroxy) butane, dicumyl peroxide, t-butyl peroxide and the like, and mixtures thereof.

The bulk polymerization temperature can be selected, for example, according to the initiator and monomers used. Generally, the molecular weight of polymer decreases as the polymerization temperature or amount of initiator increases. The bulk polymerization temperature and initiator types and concentration should be selected to obtain monomer polymerized to within about 1% to about 5% of the onset of the gel-effect and preferably to create a polymer with a weight average molecular weight in the range of from about 10,000 to about 200,000. Methods of selecting the bulk polymerization temperature and initiator types and concentration are known in the art and involve routine experimentation. This polymer will assist in the dispersion of pigment and also can coat the pigment particle and, therefore, minimize the inhibition effects of pigment on the suspension polymerization. This polymer also further improves pigment dispersion by reducing pigment aggregation.

The polymer may be cross-linked to some extent to provide improved toner and/or image anti-offset characteristics. In the present invention, either or both of the initial monomer-polymer mixture or the starved feed monomer addition may be cross-linked to impart greater thermal stability, if required. Examples of cross-linking compounds that may be selected for the process of the present invention include but are not limited to compounds having two or more polymerizable double bonds. Specific examples of such compounds include aromatic divinyl compounds such as divinylbenzene and divinylnaphthalene; carboxylic acid esters with two double bounds, such as aliphatic glycols like ethylene glycol diacrylate, ethylene glycol dimethylacrylate and the like; divinyl compounds such as divinyl ether, divinyl sulfide, divinyl sulfone and the like; and mixtures thereof. The cross-linking component should preferably be present in an amount of from about 0.1 to about 5 parts by weight in 100 parts by weight of the monomer or comonomer mixture.

Stabilizer is present in an effective amount, for example, of from about 0.01 percent to about 5 percent and more preferably from about 0.1 percent to about 2 percent by weight of the partially polymerized monomer or comonomers. Stabilizer compositions which may be selected for the process of the present invention include, but are not limited to, nonionic and ionic water-soluble polymeric stabilizers such as methyl cellulose, ethyl cellulose, hydroxypropyl cellulose, block copolymers, such as PLURONIC E87™ available from BASF, the sodium salts of carboxyl methyl cellulose, polyacrylate acids and their salts, polyvinyl alcohol, gelatins, starches, gums, alginates, casein and the like, and barrier stabilizers such as tricalcium phosphate, talc, barium sulfate and the like, and mixtures thereof.

Chain transfer agent may be selected for the present invention to control molecular weight by inhibiting chain growth. Typical of chain transfer agents that may be utilized for the process of the present invention are mercaptans, such as lauryl-mercaptan, butylmercaptan and the like, or halogenated carbons such as carbon tetrachloride or carbon tetrabromide and the like. The chain transfer agent should preferably be present in an amount of from about 0.01 percent to about 1 percent by weight of the monomer or comonomer mixture.

Numerous known pigments can be selected as the colorant for the toner particles including, for example, carbon black, such as CI (Color Index) Pigment Black 7 or REGAL 330® carbon black, nigrosine dye, aniline blue, phthalocyanine derivatives, magnetites and mixtures thereof. The pigment should be present in an effective and sufficient amount to render the toner composition colored, thereby to permit the formation of a clearly visible image. Generally, the pigment particles are present in amounts of from about 3 percent to about 20 percent by weight, based on the total weight of the toner composition; however, lesser or greater amounts of pigment particles can be selected as necessary.

When the pigment particles are comprised of magnetites or iron oxides, including those commercially available as CI Pigment Black 11, they may be present in the toner composition in an amount of from about 10 percent by weight to about 70 percent by weight, and preferably in an amount of from about 10 percent by weight to about 30 percent by weight. Alternatively, there can be selected as pigment particles mixtures of carbon black or equivalent pigments and magnetites, which mixtures, for example, may contain from about 6 percent to about 70 percent by weight of magnetite, and from about 2 percent to about 15 percent by weight of carbon black. Particularly preferred as pigments are magnetites as they enable, for example, images with no toner spots for extended time periods exceeding the development of 100,000 images, which corresponds to about 400,000 imaging cycles for a panel containing four imaging members.

Also embraced within the scope of the present invention in embodiments are colored toner compositions containing as pigments or colorants red, blue, green, brown, magenta, cyan, and/or yellow particles, and mixtures thereof. More specifically, with regard to the generation of color images utilizing the toner and developer compositions of the present invention, illustrative examples of magenta materials that may be selected include, for example, 2,9-dimethyl-substituted quinacridone and anthraquinone dye identified in the Color Index as CI 60710, CI Dispersed Red 15, a diazo dye identified in the Color Index as CI 26050, CI Solvent Red 10, CI Pigment Red 48, CI Pigment Red 122, and the like. Illustrative examples of cyan materials that may be used as pigments include copper tetra-4-(octadecyl sulfonamido) phthalocyanine, X-copper phthalocyanine pigment listed in the Color Index as CI 74160, CI Pigment Blue, and Anthrathrene Blue, identified in the Color Index as CI 69810, CI Pigment Blue 19, CI Solvent Blue 79, and the like. Illustrative examples of yellow pigments that may be selected include diarylide yellow 3,3-dichlorobenzidene acetoacetanilides, a monazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethyoxy-4-sulfonanilide phenylazo-4'-chloro-2,5-dimenthoxy acetoacetanilide, CI Pigment Yellow 31, and the like. These pigments are generally present in the toner composition in effective amounts, such as, for example, in an amount of from about 2 percent to about 15 percent by weight, based on the weight of the toner resin particles.

Illustrative examples of optional charge enhancing additives present in various effective amounts, such as, for example, from about 0.1 percent to about 20 percent by weight, and preferably from about 1 percent to about 3 percent by weight, include alkyl pyridinium halides, such as cetyl pyridinium chlorides, as disclosed in U.S. Pat. No. 4,298,672, the disclosure of which is totally incorporated herein by reference, cetyl pyridinium tetrafluoroborates, quaternary ammonium sulfate, and sulfonate charge control agents as illustrated in U.S. Pat. No. 4,338,390, the disclosure of which is totally incorporated herein by reference, stearyl phenethyl dimethyl ammonium tosylates, as disclosed in U.S. Pat. No. 4,338,390, the disclosure of which is totally incorporated herein by reference, distearyl dimethyl ammonium methyl sulfate, as disclosed in U.S. Pat. No. 4,560,635, the disclosure of which is totally incorporated herein by reference, stearyl dimethyl hydrogen ammonium tosylate, and other known similar charge enhancing additives providing the objectives of the present invention are accomplished.

With further respect to the toner and developer compositions of the present invention, another optional component includes the linear polymeric alcohol comprised of a fully saturated hydrocarbon backbone with at least about 80 percent of the polymeric chains terminated at one chain end with a hydroxyl group, which alcohol is represented by the following formula:

$CH_3(CH_2)_nCH_2OH$ wherein n is a number of from about 30 to about 300, and preferably of from about 30 to about 100, which alcohols are available from Petrolite Corporation. Particularly preferred polymeric alcohols include those wherein n represents a number of from about 30 to about 50. Therefore, in a preferred embodiment of the present invention the polymeric alcohols selected have a number average molecular weight as determined by gas chromatography of from about greater than 450 to about 1,400, and preferably of from about 475 to about 750. In addition, the aforementioned polymeric alcohols are present in the toner and developer compositions illustrated herein in various effective amounts, and can be added as uniformly dispersed internal additives, or as finely divided uniformly dispersed external additives. More specifically, as internal additives the polymeric alcohols may be present in an amount of from about 0.5 percent to about 20 percent by weight, while as external additives the polymeric alcohols may be present in an amount of from about 0.05 percent to slightly less than about 5 percent by weight. Such polymeric alcohols act as lubricants to reduce and/or eliminate "cometing" or streaking of the image.

The stabilizer on the surface of the toner particles can, if desired, be substantially removed by washing with an aliphatic alcohol containing from 1 to about 25 carbon atoms including, for example, methanol, propanol, ethanol, butanol, and the like, or water. Separation of washed toner particles from solution can be achieved by selecting any known classical separation technique such as filtration, centrifugation and the like. Classical drying techniques such as vacuum drying, freeze drying, spray drying, fluidized bed drying and the like can be selected for drying the toner.

As discussed above, the process of the present invention may be used to produce toner particles having morphologies ranging across the entire spectrum from distinct core-shell to pseudo core-shell to inverted core-shell structures and polyblends. The specific structure may be produced by properly selecting the starved feed monomer, rate of starved feed monomer addition, and conversion rate of the initial polymer at which starved feed monomer addition is commenced, as discussed above.

These morphologies will now be described in more detail with reference to the figures. For illustrative purposes only, FIGS. 1–4 show graphical representations of the varying morphologies.

FIG. 1 shows a polystyrene/polymethyl methacrylate microcapsule particle having a distinct core-shell morphology. In the particle, the starved feed methyl methacrylate monomer forms a polymethyl methacrylate shell 1 around a polystyrene core 2, formed from the initial styrene monomers and polymers.

Figure 2:
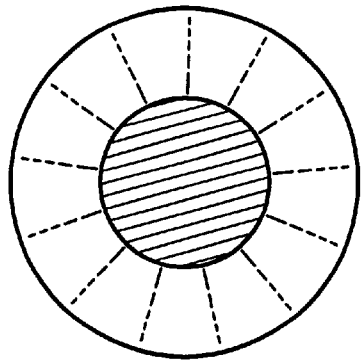
FIG. 2 shows a toner particle of the present invention having a pseudo core-shell morphology.

FIG. 2 shows a polystyrene/polymethyl methacrylate microcapsule particle having a pseudo core-shell morphology. In the particle, the starved feed methyl methacrylate monomer forms a polymethyl methacrylate pseudo shell 3 around the polystyrene core 4. In this morphology, the shell occupies a greater region than in the distinct core-shell morphology, and the boundary region between the shell and the core is less distinct.

Figure 3:
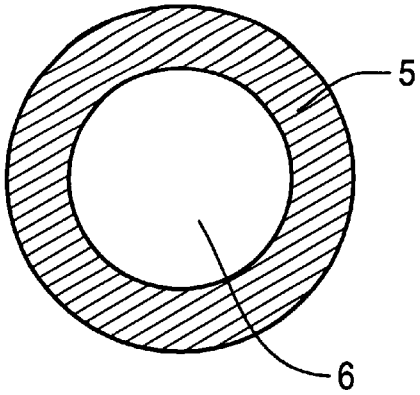
FIG. 3 shows a toner particle of the present invention having an inverted core-shell morphology.

FIG. 3 shows a polystyrene/polymethyl methacrylate microcapsule particle having an inverted core-shell morphology. In the particle, the starved feed methyl methacrylate monomer forms a polymethyl methacrylate core 6 within a polystyrene shell 5, formed from the initial styrene monomers and polymers.

Figure 4:
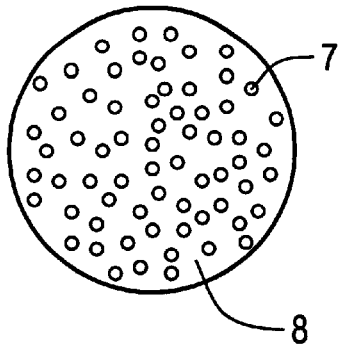
FIG. 4 shows a polyblend composite particle containing small dispersed phase domains.

FIG. 4 shows a polystyrene/polymethyl methacrylate polyblend particle having a polystyrene dispersed phase domain 7 in a polymethyl methacrylate polymer matrix continuous phase 8.

The following Examples illustrate specific embodiments and further define various species of the present invention. These Examples are intended to be illustrative only and are not intended to limit the scope of the present invention. Parts and percentages are by weight unless otherwise indicated.

EXAMPLES

Example 1

126 grams of methylmethacrylate with 5% LUPERSOL 221 (di-(n-propyl) peroxydicarbonate available from Atochem North America) initiator and 0.6 grams of divinylbenzene are polymerized up to 20% conversion at 60° C. This procedure takes 15 minutes. The mixture is then cooled to 15° C. in a water bath. The mixture is then dispersed in an aqueous phase of 404 grams of 0.75% TYLOSE (hydroxymethylcellulose available from Fluka Chemie AG) and 99.25% water. The dispersion is created by mixing the components in a high shear mixer at 10,000 rpm for 4 minutes. The dispersion is transferred to a 1 L glass reactor immersed in a water bath at 60° C., while stirring at 500 rpm. Stirring is continued for the rest of the preparation procedure. The dispersion is suspension polymerized until conversion is approximately 85%, about 4 hours, after which addition of 20 grams of styrene containing 5% LUPERSOL 221 is commenced at a rate of 0.3 mL/min. The polymerization is continued for a further 3 hours after all of the styrene has been added to complete the polymerization. After the polymerization is completed, the product is washed 4 times with water and then freeze-dried.

To a sample of the product resulting from the above process is added a stain ($RuO_4$) which preferentially stains styrene. A transmission electron micrograph of the stained sample clearly shows that the product is a polyblend having a structure of finely dispersed polystyrene in a mixture of polymethylmethacrylate. According to the present invention, this structure is predicted because the starved feed monomer (styrene) is more hydrophobic than the partially polymerized monomer (methylmethacrylate).

The polyblend particles consist of low molecular weight polystyrene domains, having Mn=2100 and Mw=4400, dispersed in a high molecular weight polymethylmethacrylate matrix having Mn=300,000 and Mw=2,500,000.

Example 2

126 grams of styrene/n-butyl methacrylate (45% styrene, 55% n-butyl methacrylate) containing 5% LUPERSOL 221 initiator and 0.6 grams of divinylbenzene are polymerized up to 30% conversion at 60° C. This procedure requires 120 minutes. The mixture is then cooled to 15° C. in a water bath. The mixture is then dispersed in an aqueous phase of 404 grams of 0.75% TYLOSE and 99.25% water. The dispersion is created by mixing the components in a high shear mixer at 10,000 rpm for 4 minutes. The dispersion is transferred to a 1 L glass reactor immersed in a water bath at 60° C., while stirring at 500 rpm. Stirring is continued for the rest of the preparation procedure. The dispersion is suspension polymerized for about 3 hours, to about 60% conversion, after which addition of 20 grams of styrene containing 5% LUPERSOL 221 is commenced at a rate of 0.2 mL/min. The polymerization is continued for a further 4 hours after all the starved feed monomer has been added to complete the polymerization. After solution polymerization is completed, the product is washed 4 times with water and then freeze-dried.

To a sample of the product resulting from the above process is added a stain ($RuO_4$) which preferentially stains styrene. A transmission electron micrograph of the stained sample clearly shows that the product has a pseudo core-shell structure. The stain indicates the presence of a styrene-rich region which is much larger than would be present if a distinct shell is formed.

Example 3

24 grams of polymethyl methacrylate (ELVACITE 2006 available from du Pont), is dissolved in 96 grams of methyl methacrylate with 5% LUPERSOL 221 initiator and 0.6 grams of divinylbenzene. The mixture is made to resemble a monomer-polymer solution after 20% conversion. The mixture is then dispersed in an aqueous phase of 404 grams of 0.75% TYLOSE and 99.25% water. The dispersion is created by mixing the components in a high shear mixer at 10,000 rpm for 4 minutes. The dispersion is transferred to a 1 L glass reactor immersed in a water bath at 60° C., while stirring at 500 rpm. Stirring is continued for the rest of the preparation procedure. The dispersion is suspension polymerized, and immediately after the polymerization begins, addition of 20 grams of styrene is commenced at a rate of 0.3 mL/min. The polymerization is continued for a further 3 hours after all of the starved feed monomer has been added to complete the polymerization. After solution polymerization is completed, the product is washed 4 times with water and then freeze-dried.

To a sample of the product resulting from the above process is added a stain ($RuO_4$) which preferentially stains styrene. A transmission electron micrograph of the stained sample clearly shows that the product has a polystyrene shell around a polymethylmethacrylate core.

Example 4

126 grams of styrene/n-butyl methacrylate (45% styrene, 55% n-butyl methacrylate) containing 4% azodimethylvaleronitrile initiator, 0.4 grams of divinylbenzene and 4% REGAL 330 carbon black are polymerized up to 25% conversion at 65° C. This procedure requires 110 minutes. The mixture is then cooled to 15° C. in a water bath. The mixture is dispersed in an aqueous phase of 404 grams of 0.75% TYLOSE and 99.25% water. The dispersion is created by mixing the components in a high shear mixer at 10,000 rpm for 4 minutes. The dispersion is transferred to a 1 L glass reactor immersed in a water bath at 60° C., while stirring at 500 rpm. Stirring is continued for the rest of the preparation procedure. The dispersion is suspension polymerized for about 3 hours until the conversion is about 55%, after which addition of 5 grams of methyl methacrylate containing 2% azodimethylvaleronitrile initiator is commenced at a rate of 0.2 mL/min. The polymerization is continued for a further 4 hours after all the methyl methacrylate starved feed monomer has been added to complete the polymerization. After polymerization is completed, the product is washed 4 times with water and then freeze-dried.

To a sample of the product resulting from the above process is added a stain ($RuO_4$). A transmission electron micrograph of the stained sample clearly shows that the product has a core-shell structure. The stain indicates the presence of a thin shell devoid of polystyrene. Methyl methacrylate is known to have a water solubility greater than either styrene or butyl methacrylate.

Using a standard testing method, the blocking temperature of the product is measured to be 70° C.

Example 5

Example 4 is repeated except that after the suspension polymerization continues for about 3 hours, 10 grams of ethyl methacrylate containing 2% azodimethylvaleronitrile initiator is added at a rate of 0.2 mL/min. The polymerization is continued for a further 4 hours after all the ethyl methacrylate starved feed monomer has been added to complete the polymerization. After polymerization is complete, the product is washed 4 times with water and then freeze-dried.

To a sample of the product resulting from the above process is added a stain ($RuO_4$). A transmission electron micrograph of the stained sample clearly shows that the product has a core-shell structure. The stain indicates the presence of a thin shell devoid of polystyrene. Ethyl methacrylate is also known to have a water solubility greater than either styrene or butyl methacrylate.

Using a standard testing method, the blocking temperature of the product is measured to be 65° C.

Example 6

126 grams of styrene/n-butyl acrylate (80% styrene, 20% n-butyl acrylate) containing 4% azodimethylvaleronitrile initiator, 0.4 grams of divinylbenzene and 5% C.I. Pigment Blue are polymerized up to 25% conversion at 65° C. This procedure requires 85 minutes. The mixture is then cooled to 15° C. in a water bath. The mixture is dispersed in an aqueous phase of 404 grams of 0.75% TYLOSE and 99.25% water. The dispersion is created by mixing the components in a high shear mixer at 10,000 rpm for 4 minutes. The dispersion is transferred to a 1 L glass reactor immersed in a water bath at 60° C., while stirring at 500 rpm. Stirring is continued for the rest of the preparation procedure. The dispersion is suspension polymerized for about 2 hours until the conversion is about 50%, after which addition of 5 grams of methyl methacrylate containing 2% azodimethylvaleronitrile initiator is commenced at a rate of 0.2 mL/min. The polymerization is continued for a further 4 hours after all the methyl methacrylate starved feed monomer has been added to complete the polymerization. After polymerization is completed, the product is washed 4 times with water and then freeze-dried.

A transmission electron micrograph of the stained sample clearly shows that the product has a core-shell structure. The stain indicates the presence of a thin shell devoid of polystyrene. Methyl methacrylate is known to have a water solubility in water greater than either styrene or butyl acrylate.

Using a standard testing method, the blocking temperature of the product is measured to be 68° C.

Example 7

Example 6 is repeated except that after the suspension polymerization has been reacted for about 3 hours, 10 grams of ethyl methacrylate containing 2% azodimethylvaleronitrile initiator is added at a rate of 0.2 mL/min. The polymerization is continued for a further 4 hours after all the ethyl methacrylate starved feed monomer has been added to complete the polymerization. After polymerization is complete, the product is washed 4 times with water and then freeze-dried.

A transmission electron micrograph of the stained sample clearly shows that the product has a core-shell structure. The stain indicates the presence of a thin shell devoid of polystyrene.

Using a standard testing method, the blocking temperature of the product is measured to be 64° C.

Example 8

126 grams of styrene/n-butyl acrylate (80% styrene, 20% n-butyl acrylate) containing 4% azodimethylvaleronitrile initiator, 0.4 grams of divinylbenzene and 5% C.I. Pigment Blue are polymerized up to 25% conversion at 65° C. This procedure requires 85 minutes. The mixture is then cooled to 15° C. in a water bath. The mixture is dispersed in an aqueous phase of 404 grams of 0.75% TYLOSE and 99.25% water. The dispersion is created by mixing the components in a high shear mixer at 10,000 rpm for 4 minutes. The dispersion is transferred to a 1 L glass reactor immersed in a water bath at 60° C., while stirring at 500 rpm. Stirring is continued for the rest of the preparation procedure. The dispersion is suspension polymerized for about 5 hours until the conversion is about 85%, after which addition of 5 grams of methyl methacrylate containing 2% azodimethylvaleronitrile initiator is commenced at a rate of 0.2 mL/min. The polymerization is continued for a further 3 hours after all the methyl methacrylate starved feed monomer has been added to complete the polymerization. After polymerization is complete, the product is washed 4 times with water and then freeze-dried.

To a sample of the product resulting from the above process is added a stain ($RuO_4$). A transmission electron micrograph of the stained sample shows that the product has a polyblend structure. The stain indicates the presence of small (about 0.1 microns) domains devoid of polystyrene distributed throughout the particle These regions represent the starved feed methyl methacrylate monomer that has polymerized and phase separated.

Comparative Example 1

Example 4 is repeated except that the suspension polymerization step is carried out for 7 hours and no starved feed monomer is added. The result is a styrene/n-butyl methacrylate copolymer resin. Transmission electron micrographs of stained particles of the product resin show that the particles do not have a core-shell structure.

Using a standard testing method, the blocking temperature of the product is measured to be 54° C.

Comparative Example 2

Example 6 is repeated except that the suspension polymerization step is carried-out for 7 hours and no starved feed monomer is added. The result is a styrene/n-butyl arylate copolymer resin. Transmission electron micrographs of stained particles of the polymer resin show that the particles do not have a core-shell structure.

Using a standard testing method, the blocking temperature of the product is measured to be 56° C.

What is claimed is:

1. A process for producing toner particles, comprising:

(a) providing a mixture of partially polymerized monomer or comonomers until a decree of conversion is within about 1% to about 5% of the onset of gel-effect;

(b) forming a suspension of the partially polymerized monomer or comonomers;

(c) suspension polymerizing the partially polymerized monomer or comonomers while commencing starved feed addition of a second monomer or comonomers;

(d) selecting a starting time of said starved feed addition into said suspension undergoing polymerization to form said toner particles;

wherein said toner particles have a particle morphology selected from the group consisting of core-shell, pseudo core-shell having a composition gradient between a shell and a core, and a polyblend of a low molecular weight dispersed phase in a high molecular weight continuous phase.

2. A process according to claim 1, wherein said mixture of step (a) is produced by polymerizing a mixture of monomer or comonomers in the presence of a polymerization initiator until said degree of conversion is within about 1% to about 5% of the onset of gel-effect.

3. A process according to claim 2, wherein said polymerization of step (a) is a bulk polymerization.

4. A process according to claim 2, further comprising stopping said polymerization of step (a) by reducing a temperature of the partially polymerized monomer.

5. A process according to claim 1, wherein said mixture of step (a) is produced by dissolving a polymer in a monomer or comonomers.

6. A process according to claim 5, wherein said mixture of step (a) further comprises a polymerization initiator.

7. A process according to claim 1, further comprising mixing pigments, charge control agents and other additives with the partially polymerized monomer or comonomers in an organic phase.

8. A process according to claim 1, further comprising washing a product of step (c) with at least one member selected from the group consisting of water and an alkyl alcohol.

9. A process according to claim 1, further comprising dry blending a product of step (c) with a flow additive.

10. A process according to claim 1, wherein said suspension is an aqueous suspension containing water in an amount of from about 2 to about 5 times by volume the mixture of step (a).

11. A process according to claim 1, wherein said suspension is an aqueous suspension, and a stabilizing component is present in an amount of from about 0.1 percent to about 5 percent by weight of the partially polymerized monomer or comonomers.

12. A process according to claim 1, wherein said suspension polymerization of step (c) further comprises the starved feed addition of a polymerization initiator.

13. A process according to claim 1, wherein said starved feed addition is at a rate of addition less than or equal to the rate of monomer absorption in the partially polymerized monomer or monomers due to reaction and swelling.

14. A process according to claim 1, wherein said starting time of starved feed addition is controlled to form toner particles that are microcapsules having a distinct core-shell morphology.

15. A process according to claim 14, wherein said second monomer or comonomers form a shell of said microcapsules.

16. A process according to claim 14, wherein said second monomer or comonomers form a core of said microcapsules.

17. A process according to claim 1, wherein said starting time of starved feed addition is controlled to form toner particles that are microcapsules having a pseudo core-shell morphology with a composition gradient between said shell and said core.

18. A process according to claim 1, wherein said second monomer or comonomers are more hydrophobic than the partially polymerized monomer or comonomers.

19. A process according to claim 18, wherein a polymer of said monomer or comonomers and a polymer of said second monomer or comonomers are immiscible in each other.

20. A process according to claim 18, wherein the partially polymerized monomer or comonomers are suspension polymerized in step (c) to at least 80% conversion prior to the starved feed addition of the second monomer or comonomers.

21. Toner particles having a pseudo core-shell microcapsule morphology produced by the process of claim 1, said particles consisting of a shell and a core having a composition gradient between said shell and said core.

22. Toner particles having a polyblend morphology of a low molecular weight dispersed phase having domain sizes from about 0.05 to about 0.3 microns in a high molecular weight continuous phase, produced by the process of claim 1, wherein said dispersed phase and said continuous phase are formed without a block copolymer compatibilizer.

23. Toner particles according to claim 22, wherein said low molecular weight dispersed phase has a weight average molecular weight of less than about 5,000 and said high molecular weight continuous phase has a weight average molecular weight of from about 20,000 to about 3,000,000.

24. Toner particles having a polyblend morphology of a low molecular weight dispersed phase in a high molecular weight continuous phase produced by the process of claim 1, wherein the molecular weight of said low molecular weight dispersed phase is controlled by selecting an amount of at least one component selected from the group consisting of a polymerization initiator, a cross-linking agent, and a chain transfer agent during said starved feed addition.

25. A process for producing a toner, comprising:

(a) providing a mixture of partially polymerized monomer or comonomers having a degree of conversion of said monomer or comonomer to polymer within about 1% to about 5% of the onset of gel-effect;

(b) mixing at least one of a pigment, charge control agent and other toner additives with the partially polymerized monomer or comonomers to form an organic phase;

(c) dispersing the organic phase into from about 2 to about 5 times its volume of water containing from about 0.1 to about 5 weight percent of a stabilizing component;

(d) initiating suspension polymerization of the dispersion;

(e) commencing starved feed addition of a second monomer or comonomers at a rate of addition less than a rate of absorption of the second monomer or comonomers in the partially polymerized monomer or comonomers due to reaction swelling;

(f) selecting a starting time of said starved feed addition into said suspension undergoing polymerization;

(g) fully polymerizing the starved fed monomer or comonomers to form toner particles;

(h) washing, separating and drying the toner particles of step (g);

wherein said toner particles have a particle morphology selected from the group consisting of core-shell, pseudo core-shell having a composition gradient between a shell and a core, and a polyblend of low molecular weight dispersed phase in a high molecular weight continuous phase.

26. A process according to claim 25, further comprising dry blending the toner particles with flow additives.

27. A process according to claim 25, said step (a) comprising:

mixing a monomer or comonomers with a polymerization initiator;

bulk polymerizing the monomer or comonomers until said degree of conversion is within about 1% to about 5% of onset of gel-effect;

stopping the bulk polymerization process by reducing a temperature of the partially polymerized monomer or comonomers.

28. A process according to claim 25, said step (a) comprising dissolving a polymer in a monomer or comonomers to form a solution.

29. A process according to claim 28, said solution further comprising a polymerization initiator.

* * * * *